US007742002B2

(12) United States Patent
Cheng et al.

(10) Patent No.: US 7,742,002 B2
(45) Date of Patent: Jun. 22, 2010

(54) ANTENNA DEVICE WITH RADIATION PATTERN ADJUSTMENT ELEMENT

(75) Inventors: Yu-Chiang Cheng, Taipei (TW); Ping-Cheng Chang, Chaozhou Town (TW); Cheng-Zing Chou, Xinying (TW)

(73) Assignee: Getac Technology Corp., Taipei, Tainan (CN)

( * ) Notice: Subject to any disclaimer, the term of this patent is extended or adjusted under 35 U.S.C. 154(b) by 25 days.

(21) Appl. No.: 11/404,813

(22) Filed: Apr. 17, 2006

(65) Prior Publication Data

US 2007/0216579 A1 Sep. 20, 2007

(30) Foreign Application Priority Data

Mar. 14, 2006 (TW) ..... 95108646 A

(51) Int. Cl.
*H01Q 1/24* (2006.01)
*H01Q 1/38* (2006.01)

(52) U.S. Cl. ..... 343/702; 343/700 MS

(58) Field of Classification Search ..... None
See application file for complete search history.

(56) References Cited

U.S. PATENT DOCUMENTS

| | | | | |
|---|---|---|---|---|
| 6,445,577 | B1 * | 9/2002 | Madsen et al. | 361/683 |
| 6,628,230 | B2 * | 9/2003 | Mikami et al. | 342/175 |
| 7,149,548 | B2 * | 12/2006 | Mori et al. | 455/562.1 |
| 7,164,387 | B2 * | 1/2007 | Sievenpiper | 343/702 |
| 2007/0103367 | A1 * | 5/2007 | Wang | 343/700 MS |
| 2007/0210963 | A1 * | 9/2007 | Cheng et al. | 343/700 MS |
| 2007/0216581 | A1 * | 9/2007 | Cheng et al. | 343/702 |

FOREIGN PATENT DOCUMENTS

JP 2003-332836 * 11/2003

OTHER PUBLICATIONS

Afzalzadeh, R., et al.; "X-Band Directive Single Microstrip Path Antenna Using Dielectric Parasite"; Electronics Letters; Jan. 2, 1992, vol. 28, No. 1, pp. 17-19.

* cited by examiner

*Primary Examiner*—Trinh V Dinh
(74) *Attorney, Agent, or Firm*—Apex Juris, pllc; Tracy M Heims

(57) ABSTRACT

Disclosed is an antenna device for transceiving a wireless signal. The antenna device includes an antenna element adapted to establish a radiation pattern during transceiving the wireless signal; an antenna signal feeding line coupling to the antenna element for feeding the wireless signals transceived by the antenna element; and at least one radiation pattern adjustment element arranged at an adjacent position with respect to the antenna element and within the established radiation pattern of the antenna element to adjust the radiation pattern of the antenna element.

9 Claims, 7 Drawing Sheets

ANTENNA DEVICE WITH RADIATION PATTERN ADJUSTMENT ELEMENT

FIELD OF THE INVENTION

The present invention relates to an antenna device used in wireless technology, and in particular to an antenna device with at least a radiation pattern adjustment element.

BACKGROUND OF THE INVENTION

It is well known that an antenna is the key element to transmit/receive (transceive) microwaves in wireless technology such as wireless communication and wireless data transfer, where the antenna transforms electrical currents generated by a transmitter into microwaves and transmits the microwaves in free space. The antenna also captures microwaves and transforms them into electrical currents, which are then processed by a receiver.

Further, electromagnetic pulse, which is generated by the presence of electric currents in an antenna, radiates in to free space from the site of an antenna by the speed of light, and the direction of which the electric field travels is perpendicular to the direction of the travel of the electromagnetic pulse. The electric field is related to only two parameters, and they are the distance and the radiation angle. The intensity of the electric field decreases with the square of the distance from the antenna, and the graphical representation of the intensity of the radiation of the electric field to the radiation angle from the perpendicular is defined as a radiation pattern.

Please refer to FIG. 1 that shows an established radiation pattern of a typical omni-directional antenna in conventional use. As shown in the figure, the electric field of an omni-directional antenna A in a horizontal plane H that is perpendicular to the antenna A is denoted as a radiation pattern P, and the radiation pattern P is the largest in intensity of all radiation patterns of the antenna A (in comparison with radiation patterns lying in planes not perpendicular to the antenna A). Besides, due to the omni-directional characteristic of the antenna A, the radiation pattern P is of approximately equal intensity in every direction (i.e. radiation angle) in the horizontal plane H.

FIG. 2, a view of a radiation pattern of another typical omni-directional antenna of conventional use, shows the radiation pattern P1 of an omni-directional antenna A1 in the horizontal plane H that is perpendicular to the antenna Al. It is obvious that the intensity of every position with the established radiation pattern P1 in the horizontal plane H is of approximate equivalence.

On the other hand, wireless technology such as peer-to-peer connection and satellite communications are best fit with antennas that concentrate their electric field to a rather small region. Since such antennas are of focused radiation, their overall power of the energy output is able to decrease to a desired level, while the energy density per unit area is able to increase to a certain amount. The radiation of such antennas in other directions, therefore, is relatively weak in intensity and small in coverage-the physical geological area where signal is still at a level that can be transceived-and that reduces the occasions of meaningless electromagnetic interferences. Such antennas are the so-called directional antennas.

FIG. 3 is a view of an established radiation pattern of a typical directional antenna of conventional use, and a radiation pattern P2 of a directional antenna A2 in the horizontal plane H that is perpendicular to the antenna A2 is shown in the figure. Apparently, the intensity of radiation at any position within the radiation pattern P2 in the horizontal plane H exists no equivalence.

Further, omni-directional antennas of the electronic devices in conventional use are those of dipole antennas, Marconi antennas, etc., while directional antennas of the same use are those of flat antennas, microstripe antenna, disk antenna, and PIFA antennas. In addition, once the kind of antenna used in an electronic device is determined in advance, the omni-directional or the directional characteristic of the electronic device with the specific kind of the antenna arranged therein is determined.

Although an electronic device with an omni-directional antenna is noted with the homogeneity of the radiation pattern the antenna generates, the distance of the wireless signal transceiving of the omni-directional antenna is relatively shorter than that of a directional antenna of the same power in a desired direction, while the gain, which is the relative increase in radiation at the maximum point expressed as a value in dB above a standard, is smaller than that of a directional antenna in the direction of focused radiation pattern. However, an electronic device with a directional antenna, on the contrary, is strongly limited by the direction when it comes to the transceiving of wireless signals.

SUMMARY OF THE INVENTION

A primary object of the present invention, therefore, is to provide an antenna device with at least one radiation pattern adjustment element to adjust the radiation pattern of an antenna element by a simple element.

Another object of the present invention is to provide an antenna device to adjust the radiation pattern of an omni-directional antenna, in order to increase the gain and improve the signal transceiving ability of the omni-directional antenna.

A further object of the present invention is to provide an antenna device to adjust the radiation pattern of a directional antenna, with the aim to further increase the directional of the radiation pattern, and the gain of the directional antenna in a desired direction as a consequence.

A further object of the present invention is to provide an antenna device to adjust the radiation pattern of a directional antenna, in order to alleviate the directional limitation of such antenna.

To realize the above objects, the present invention installs an antenna device with an antenna element adapted to establish a radiation pattern during the transceiving of the wireless signal and at least one radiation pattern adjustment element arranged at an adjacent position with respect to the antenna element and within the established radiation pattern of the antenna element to adjust the radiation pattern of the antenna element. Moreover, the radiation pattern adjustment element could be a magnetic material with a predetermined permeability or a dielectric material with predetermined dielectric constant.

In the preferred embodiment of the present invention, the radiation pattern adjustment element could be arranged at adjacent positions above, below, or beside the antenna element, while the arrangement of the radiation pattern adjustment element within positions where the intensity of the radiation pattern of the antenna element is relatively stronger and relatively weaker is also feasible.

In comparison with the conventional technologies, the present invention enables an antenna device and an electronic device equipped with the same to adjust the radiation pattern of an antenna element, which brings about the increase in gain of an omni-directional antenna, the increase in directionality of such antenna, and the improvement of the transceiving of wireless signals. Besides, the present invention not only alleviates the limitation in directionality of a directional antenna, but also increases the gain of such antenna in desired directions by further enhance the directionality of a directional antenna. The present invention, therefore, achieves what is desired when applied to either an omni-directional antenna or a directional one.

These and other objects, features and advantages of the invention will be apparent to those skilled in the art, from a reading of the following brief description of the drawings, the detailed description of the preferred embodiment, and the appended claims.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 4:
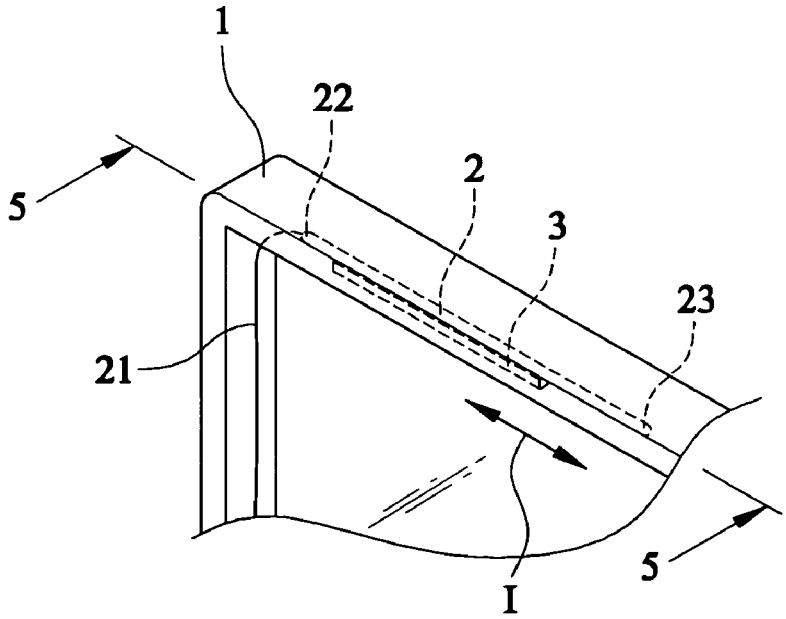
FIG. 4 is an assembled perspective view of an antenna device with a radiation pattern adjustment element in accordance with a first embodiment of the present invention.
Figure 5:
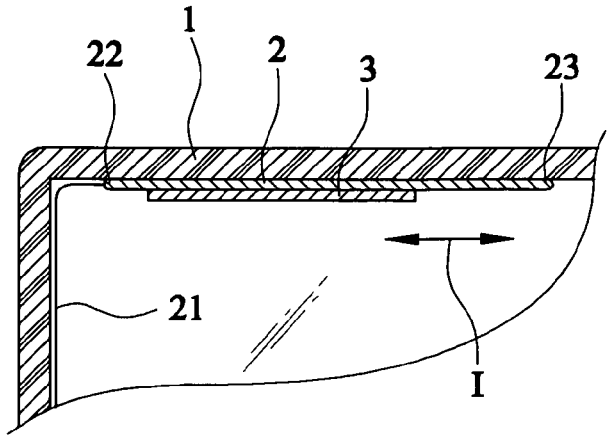
FIG. 5 is a sectional view taken along line 5-5 of FIG. 4.

With reference to the drawings and in particular to FIGS. 4 and 5 that are an assembled perspective view of an antenna device with an established radiation pattern adjustment element in accordance with a first embodiment of the present invention and a sectional view taken along line 5-5 of FIG. 4. As shown in the figures an electronic device, which is generally denoted a numeral reference 1, includes an antenna element 2, which is an omni-directional antenna, and a radiation pattern adjustment element 3.

The antenna element 2 is electrically connected to an antenna signal feeding line 21 to electrically conduct the wireless signals between the antenna element 2 and the electronic device 1. The antenna element 2 further includes a signal-feeding end 22 and a terminal end 23, wherein the signal-feeding end 22 electrically connects the antenna signal feeding line 21. Besides, the radiation pattern adjustment element 3 is arranged at a position below the antenna element 2, and the radiation pattern adjustment element 3 is arranged in a direction parallel to an extended direction I of the antenna element 2.

Figure 1:
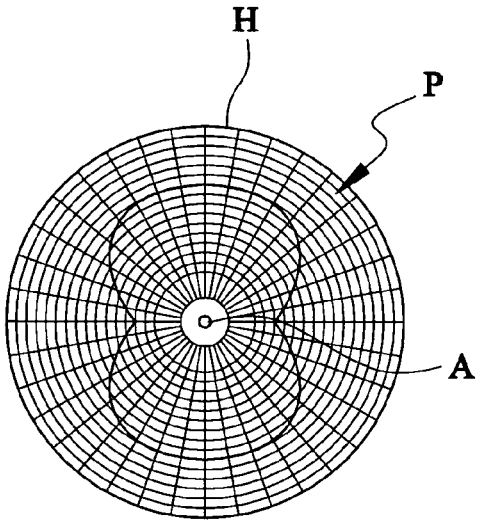
FIG.1(Prior Art)
FIG. 1 is a view of an established radiation pattern of a typical omni-directional antenna of conventional use.
Figure 6:
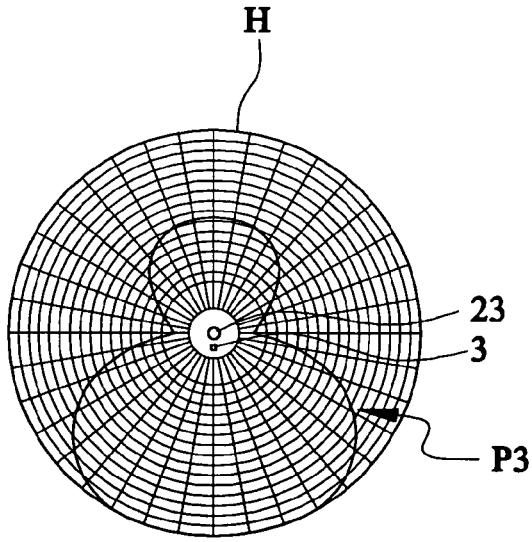
FIG. 6 shows an established radiation pattern in accordance with the first embodiment.

As shown in FIG. 6, which shows an established radiation pattern in accordance with the first embodiment of the present invention, the horizontal plane H is perpendicular to the extended direction I of the antenna element 2, and the center of the horizontal plane H is the terminal end 23 of the antenna element 2. Arranged below the terminal end 23 is the radiation pattern adjustment element 3. After the adjustment of the radiation pattern adjustment element 3, the omni-directional radiation pattern P1 generated by the omni-directional antenna element 2 as shown in FIG. 1 is transformed into a directional radiation pattern P3 as a consequence.

Figure 2:
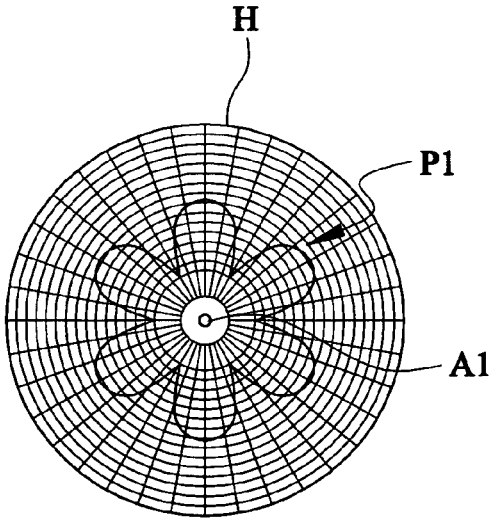
FIG.2(Prior Art)
FIG. 2 is a view of an established radiation pattern of another typical omni-directional antenna of conventional use.
Figure 3:
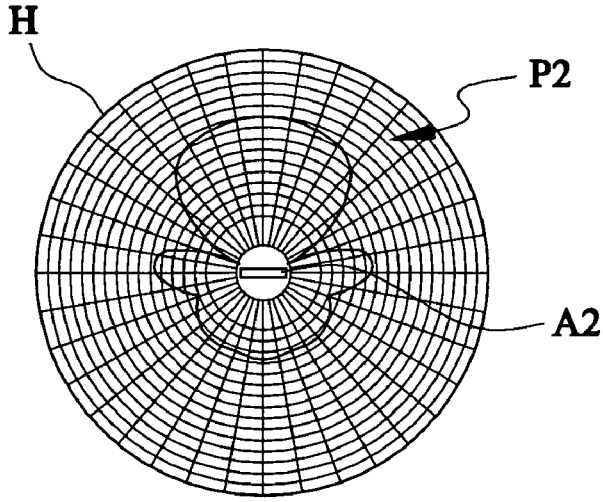
FIG.3(Prior Art)
FIG. 3 is a view of an established radiation pattern of a typical directional antenna of conventional use.
Figure 7:
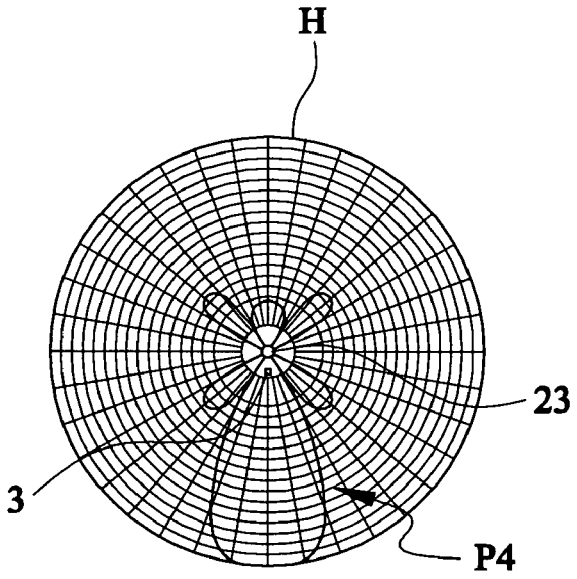
FIG. 7 shows another established radiation pattern in accordance with the first embodiment.

Please refer to FIG. 7 that shows another established radiation pattern in accordance with the first embodiment. The omni-directional radiation pattern P2 generated by the antenna element 2 as shown in FIG. 2 is transformed into a directional radiation pattern P4 after the adjustment of the radiation pattern adjustment element 3 is shown in the figure.

Figure 8:
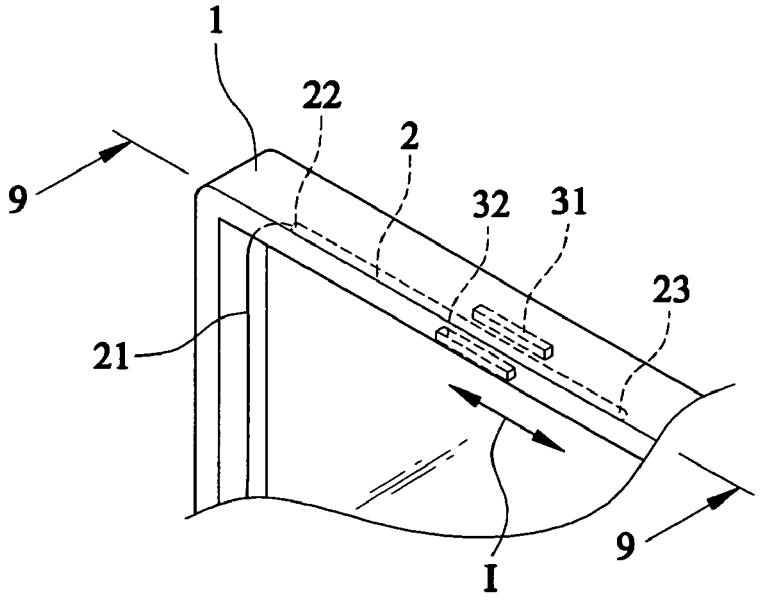
FIG. 8 is an assembled perspective view of an antenna device with radiation pattern adjustment element in accordance with a second embodiment of the present invention.
Figure 9:
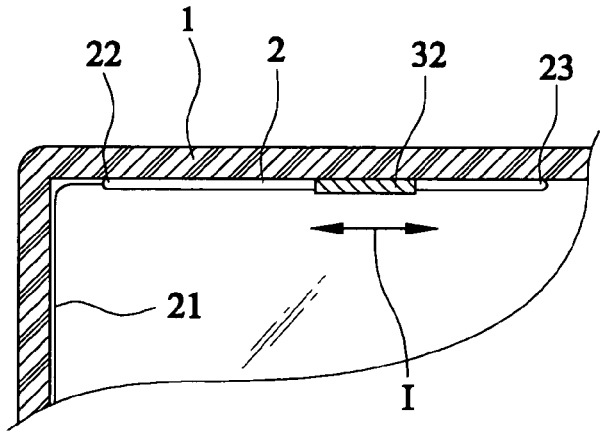
FIG. 9 is a sectional view taken along line 9-9 of FIG. 8.

With reference to FIGS. 8 and 9 that are an assembled perspective view of an antenna device with radiation pattern adjustment element in accordance with a second embodiment of the present invention and a sectional view taken along line 9-9 of FIG. 8. As shown in the figures, an electronic device 1 includes an antenna element 2 and multiple radiation pattern adjustment elements 31 and 32, wherein the antenna element 2 is an omni-directional antenna.

The antenna element 2 is electrically connected to an antenna signal feeding line 21 to conduct the wireless signals between the electronic device 1 and the antenna element 2. Further, the antenna element 2 also includes a signal-feeding end 22 and a terminal end 23, wherein the signal-feeding end 22 electrically connects the antenna signal feeding line 21. Moreover, the radiation pattern adjustment elements 31 and 32 are arranged at positions beside the antenna element 2 and in a direction parallel to an extended direction I of the antenna element 2.

Figure 10:
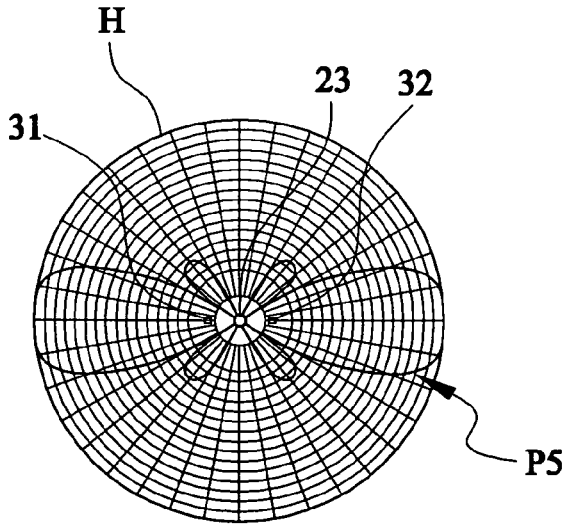
FIG. 10 shows an established radiation pattern in accordance with the second embodiment.

Please refer to FIG. 10 that shows an established radiation pattern in accordance with the second embodiment of the present invention. As shown in the figure, the horizontal plane H is perpendicular to the extended direction I of the antenna element 2, and the center of the horizontal plane H is the terminal end 23 of the antenna element 2. Arranged beside the terminal end 23 are the radiation pattern adjustment elements 31 and 32. After the adjustment of the radiation pattern adjustment elements 31 and 32, the omni-directional radiation pattern generated by the omni-directional antenna element 2 is then transformed into a directional radiation pattern P5.

Figure 11:
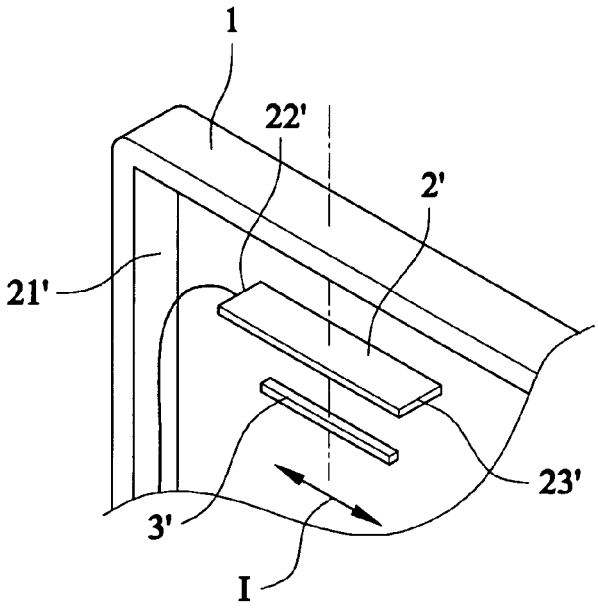
FIG. 11 is an exploded perspective view of an antenna device with radiation pattern adjustment element in accordance with a third embodiment of the present invention.

FIG. 11 is an exploded perspective view of an antenna device with a radiation pattern adjustment element in accordance with a third embodiment of the present invention. As shown in the figure, an electronic device 1 includes an antenna device 2', which is a directional antenna, and a radiation pattern adjustment element 3'. The antenna element 2' is electrically connected to an antenna signal feeding line 21' to conduct the wireless signals between the electronic device 1 and the antenna element 2'. The antenna element 2' further includes a signal-feeding end 22' and a terminal end 23', wherein the signal-feeding end 22' serves as a mean to connect the antenna signal feeding line 21'. In addition, the radiation pattern adjustment element 3' is arranged below the antenna element 2' and in a direction parallel to an extended direction I of the antenna element 2'.

Figure 12:
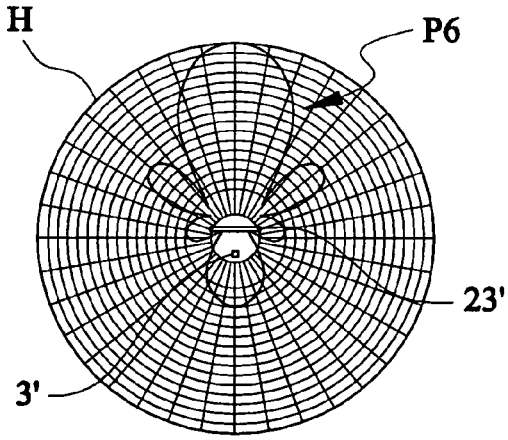
FIG. 12 shows an established radiation pattern in accordance with the third embodiment.

As shown in FIG. 12, which is an established radiation pattern in accordance with the third embodiment of the present invention, the horizontal plane H is perpendicular to the extended direction I of the antenna element 2', and the center of the horizontal plane H is the terminal end 23' of the antenna element 2'. Arranged under the terminal end 23' is the radiation pattern adjustment element 3'. After the adjustment of the radiation pattern adjustment element 3', the directional radiation pattern generated by the directional antenna element 2' is then transformed into a radiation pattern P6 with a weaker directionality.

Figure 13:
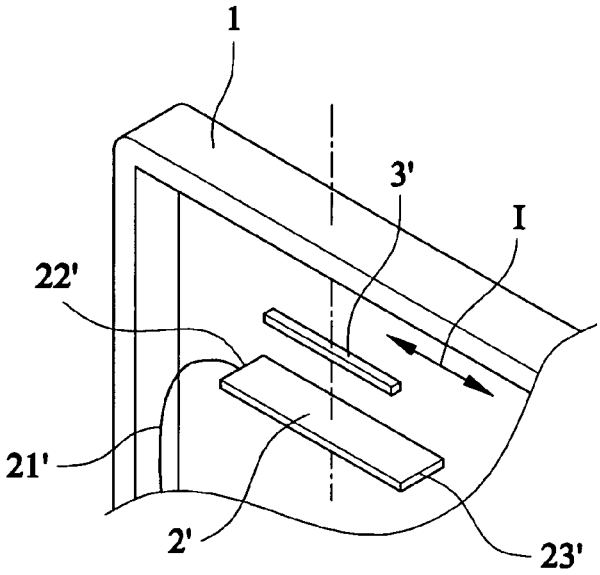
FIG. 13 is an exploded perspective view of an antenna device with radiation pattern adjustment element in accordance with a fourth embodiment of the present invention.

Please refer to FIG. 13 that is an exploded perspective view of an antenna device with a radiation pattern adjustment element in accordance with a fourth embodiment of the present invention. As shown in the figure, an electronic device 1 is provided with an antenna device 2', which is a directional antenna, and a radiation pattern adjustment element 3'. The antenna element 2' is electrically connected to an antenna signal feeding line 21' to conduct the wireless signals between the electronic device 1 and the antenna element 2'. The antenna element 2' further includes a signal-feeding end 22' and a terminal end 23', wherein the signal-feeding end 22' connects the antenna element 2' with the antenna signal feeding line 21'. In addition, the radiation pattern adjustment element 3' is arranged above the antenna element 2' and in a direction parallel to an extended direction I of the antenna element 2'.

Figure 14:
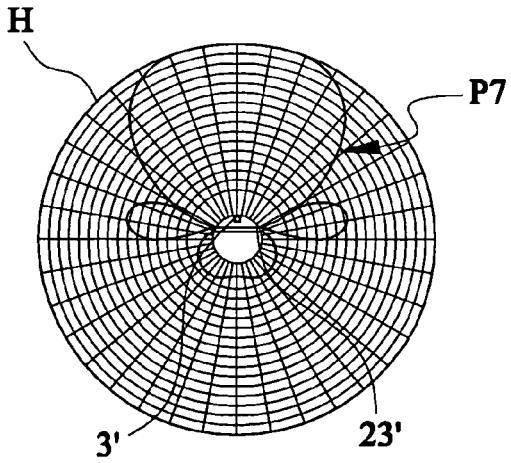
FIG. 14 shows an established radiation pattern in accordance with the fourth embodiment.

FIG. 14 shows an established radiation pattern according to the fourth embodiment. As shown in the figure, the horizontal plane H is perpendicular to the extended direction I of the antenna element 2', and the center of the horizontal plane H is the terminal end 23' of the antenna element 2'. Arranged above the terminal end 23' is the radiation pattern adjustment element 3'. After the adjustment of the radiation pattern adjustment element 3', the directional radiation pattern generated by the directional antenna element 2' is then transformed into a radiation pattern P7 with an even stronger directionality.

In the embodiments of the present invention, the radiation pattern adjustment element could be either a magnetic material or a dielectric material with, respectively, a specific permeability or a specific dielectric constant. Besides, the choice of the magnetic material or the dielectric material could be determined by the corresponding frequencies of the wireless signals transceived by the antenna element. In addition, the coupling between the antenna pattern and the antenna signal feeding line could either be a direct wire-connection or an antenna coupling element (which the antenna signal feeding line is directly connected to the antenna coupling element, and the antenna pattern is coupled with the antenna coupling element.)

Since the radiation pattern adjustment elements 3, 3', 31, and 32 of the antenna devices 2 and 2' are mainly used to adjust the radiation patterns of the antenna elements, it is understood that any other type of radiation pattern adjustment element with any other figure, structure, magnetic characteristics, and electric characteristics can be used in the present invention to replace the radiation pattern adjustment elements 3, 3', 31, and 32.

Follow the above statement, the present invention enables an antenna device and an electronic device equipped with the same to adjust the radiation pattern of an antenna element, which makes feasible the increase in gain of an omni-directional antenna, the increase in directionality of such antenna, and the improvement of the transceiving of wireless signals. In addition, the present invention not only alleviates the limitation in directionality of a directional antenna, but also increases the gain of such antenna in desired directions by further enhance the directionality of a directional antenna.

While the invention has been described in connection with what is presently considered to the most practical and preferred embodiments, it is to be understood that the invention is not to be limited to the disclosed embodiments, but on the contrary, is intended to cover various modifications and equivalent arrangement included within the spirit and scope of the appended claims.

What is claimed is:

1. An antenna device for transceiving a wireless signal, comprising:

a longitudinally extended antenna element adapted to establish a radiation pattern during transceiving the wireless signal;

an antenna signal feeding line coupled to the antenna element for feeding the wireless signals transceived by the antenna element; and at least one longitudinally extended radiation pattern adjustment element, consisting of magnetic material and being arranged at an adjacent position with respect to the antenna element and within the established radiation pattern of the antenna element, the at least one longitudinally extended radiation pattern adjustment element being displaced in a longitudinally direction of the antenna element to adjust the radiation pattern of the antenna element.

2. The antenna device as claimed in claim 1, wherein the antenna signal feeding line is directly connected to the antenna element.

3. The antenna device as claimed in claim 1, wherein the antenna element is an omni-directional antenna adapted to establish an omni-directional radiation pattern.

4. The antenna device as claimed in claim 1, wherein the antenna element is a directional antenna adapted to establish a directional radiation pattern comprising at least one stronger radiation pattern area and at least one weaker radiation pattern area.

5. The antenna device as claimed in claim 4, wherein the radiation pattern adjustment element is arranged at a position within the stronger radiation pattern area.

6. The antenna device as claimed in claim 4, wherein the radiation pattern adjustment element is arranged at a position within the weaker radiation pattern area.

7. The antenna device as claimed in claim 1, wherein the radiation pattern adjustment element is located above the antenna element.

8. The antenna device as claimed in claim 1, wherein the radiation pattern adjustment element is located below the antenna element.

9. The antenna device as claimed in claim 1, wherein the radiation pattern adjustment element is located in side-by-side relationship with respect to the antenna element.

* * * * *